US011344115B2

(12) United States Patent
Mitchell et al.

(10) Patent No.: US 11,344,115 B2
(45) Date of Patent: May 31, 2022

(54) SYSTEM OF RACKS FOR SPACE SAVING STORAGE

(71) Applicant: HARVEST SUPPLY CANADA INC., Port Colborne (CA)

(72) Inventors: Albert E. Mitchell, Port Colborne (CA); Lily Zhou, Port Colborne (CA); Ryan Gu, Port Colborne (CA); Bryan Paul Huisman, Port Colborne (CA)

(73) Assignee: HARVEST SUPPLY CANADA INC., Port Colborne (CA)

( * ) Notice: Subject to any disclaimer, the term of this patent is extended or adjusted under 35 U.S.C. 154(b) by 0 days.

(21) Appl. No.: 17/100,626

(22) Filed: Nov. 20, 2020

(65) Prior Publication Data

US 2021/0153646 A1 May 27, 2021

Related U.S. Application Data

(60) Provisional application No. 62/938,492, filed on Nov. 21, 2019.

(51) Int. Cl.
*A47B 47/02* (2006.01)
*A47B 43/00* (2006.01)
(Continued)

(52) U.S. Cl.
CPC ..... *A47B 47/027* (2013.01); *A47B 43/00* (2013.01); *A47B 47/05* (2013.01); *A47B 57/12* (2013.01)

(58) Field of Classification Search
CPC ..... A47B 47/027; A47B 47/05; A47B 57/12; A47B 43/00; A47B 2031/003; A47B 2031/004; A47B 2031/005
See application file for complete search history.

(56) References Cited

U.S. PATENT DOCUMENTS 1,445,259 A * 2/1923 Wiselogel ..... B65D 7/20 220/491
3,303,938 A * 2/1967 Solomon ..... A47F 7/24 211/182

(Continued)

OTHER PUBLICATIONS

Website: M&E Mfg. Co., Inc., https://zframerack.com/z-frame-home/why-z-frame-rack/; publication date unknown; first retrieved on Nov. 20, 2019; copy date Nov. 25, 2021.

*Primary Examiner* — Stanton L Krycinski

(57) ABSTRACT

A system of racks comprising of at least two racks that can be nested together when they are not in use thereby minimizing the space required for their collective storage. Each rack is comprised of a frame having two or more frame elements linked together by at least one Z-shaped bracket. Each frame element is comprised of two vertical support members linked by a plurality of tray holders at spaced apart distances along the interior side(s) of the vertical support members. The plurality of tray holders on each of the frame elements linked by a Z-shaped bracket are substantially aligned in the vertical direction thereby forming a set of pairs of tray holders. Each pair of tray holders is configured to receive and support the placement of trays. The trays comprise of a flat base portion with upstanding side edges which may be welded to a wire element to reduce crevices where debris and contaminants may otherwise be trapped and to assist with cleaning of the trays. When the racks are not in use, the trays are removed allowing the racks to nest together along their Z-shaped bracket.

23 Claims, 10 Drawing Sheets

(51) Int. Cl.
*A47B 57/12* (2006.01)
*A47B 47/05* (2006.01)

(56) References Cited

U.S. PATENT DOCUMENTS 3,827,376 A * 8/1974 Solomon ..... A47B 31/04 108/91
3,921,814 A * 11/1975 Solomon ..... A47F 7/24 211/162
3,963,125 A * 6/1976 Baggott ..... A47B 31/00 211/126.15
4,054,209 A * 10/1977 Solomon ..... A47F 7/24 211/208
5,125,520 A * 6/1992 Kawasaki ..... A47B 31/04 108/91
5,330,064 A 7/1994 Hall
5,386,787 A 2/1995 Hall
5,471,922 A 12/1995 Hall
5,503,087 A 4/1996 Hall
5,628,522 A 5/1997 Hall
5,685,442 A * 11/1997 Yoshino ..... A47B 43/00 211/126.1
5,957,309 A 9/1999 Hall
6,149,120 A 11/2000 Hall
6,203,035 B1 * 3/2001 Ondrasik ..... B62B 3/006 211/126.1
6,322,180 B1 11/2001 Hall
6,366,313 B1 4/2002 Hall
6,382,434 B1 * 5/2002 Silberg ..... A47F 5/137 211/195
6,419,098 B1 * 7/2002 Hall ..... A47B 47/021 211/126.2
6,474,757 B2 11/2002 Hall et al.
D480,528 S 10/2003 Hall
D481,513 S 10/2003 Hall
D483,540 S * 12/2003 Murray ..... D34/12
6,974,042 B2 12/2005 Hall
D514,269 S * 1/2006 Polidoros ..... D34/17
7,419,063 B1 9/2008 Hall
7,631,773 B1 * 12/2009 Calabrisotto ..... A47B 61/00 211/196
8,196,874 B2 * 6/2012 Zitting ..... B62B 3/006 248/121
9,440,667 B1 9/2016 Hall
9,661,858 B2 * 5/2017 Warren ..... A21B 1/50
10,087,066 B1 10/2018 Hall
10,363,952 B2 * 7/2019 Green ..... B62B 3/10
2015/0291311 A1 * 10/2015 Meza Cabello ..... B65D 25/02 220/4.03

* cited by examiner

SYSTEM OF RACKS FOR SPACE SAVING STORAGE

CROSS-REFERENCE

This application claims the benefit of U.S. Provisional Application No. 62/938,492 filed Nov. 21, 2019, the content of which is incorporated herein by reference in its entirety.

FIELD

The following disclosure relates to a rack system (e.g. comprising trays) and more particularly to a system of racks designed to be nested together for space saving storage.

BACKGROUND

The cooling, drying, or aerating of goods is often most effective when the goods are separated from each other. Examples may include the cooling of freshly baked cookies, the drying of rose petals, and the aerating of odorous clothes. In order to facilitate these processes, a large surface area is often required.

Racks help to minimize the total floor space required for any given surface area by providing a structure for these goods to be spaced apart from each other in the vertical direction. When racks are not in use, however, they may unnecessarily take up the same amount of floor space as they would when they are in use. A rack system designed to take up less floor space when the system is not in use is desirable particularly in circumstances where space is limited.

SUMMARY

There is provided a rack for space saving having a frame in which opposite exterior frame elements are spanned via one or more Z-shaped brackets. The rack may have one or more interior frame elements disposed between the exterior frame elements and attached to the Z-shaped brackets. When not in use, such as to take up less space, the rack may be nested with a second rack having Z-shaped brackets.

There is provided a rack comprising a frame having two or more frame elements linked together by at least one Z-shaped bracket, where a first frame element is linked to a second frame element by at least one Z-shaped bracket and, when present, the second frame element is linked to a third frame element by at least one Z-shaped bracket. Each Z-shaped bracket comprises a pair of parallel members and a diagonal member joined therebetween and a respective joint member at each joint between the diagonal member and a respective one of the pair of parallel members, each joint member providing a planar crevice sealing surface. At each joint: respective first surfaces of the diagonal member, the respective one of the pair of parallel members and the respective joint member define an first smooth co-planer surface; and respective opposite surfaces of the diagonal member, the respective one of the pair of parallel members and the respective joint member define an opposite smooth co-planer surface.

Each of the two or more frame elements are configured to cooperatively support a plurality of removable trays, one tray on top of, and spaced from, another tray. Each of the frame elements may comprise two spaced vertical support members (e.g. bars or beams, etc.) linked by a plurality of tray holders at spaced apart distances between the tray holders. The tray holders may be positioned on a particular frame element to face another of the frame elements to which the particular frame element is directly connect by a Z-shaped bracket when the rack is assembled. The plurality of tray holders are spaced to be substantially aligned in the vertical direction thereby forming sets of pairs of tray holders between two connected frame elements to hold individual trays. Each of the pairs of tray holders may be configured to receive and support a respective tray in a substantially horizontal orientation. When the rack is not in use, the trays are removable allowing the rack to nest together with another rack along their Z-shaped brackets.

Opposite sides of a tray may each comprise an outwardly projecting flange about a top opening of the tray. The opposite projecting flanges may be received by a pair of tray holders. The tray holders may comprise L-shaped brackets. The rack may be provided with wheels, casters or other apparatus to facilitate movement of the racks.

The trays may be perforated to assist with drying. The flanges may comprise a wire element extending around the tray opening. The wire element may be welded to the tray body. The tray body may comprise a flat base portion with upstanding side edges forming the opening. The base portion and optionally the upstanding side edges may be perforated with perforations of any shapes or sizes. The upstanding edges may be welded to the wire element to reduce crevices where debris and contaminants may otherwise be trapped and to assist with cleaning of the trays. In another embodiment, the upstanding edges wrap around the wire element.

The racks and trays may be made of a food grade material such as stainless steel and suitable plastic materials.

Also provided herein are trays as shown and described.

There is provided a system of racks comprising of at least two racks that can be nested together when they are not in use thereby minimizing the space required for their collective storage. Each rack is comprised of at least one unit which is defined by two frame elements linked together by at least one Z-shaped bracket. The two frame elements are each comprised of two vertical support members linked by a plurality of tray holders at spaced apart distances along the interior side of the vertical support members, and wherein the plurality of tray holders on either side of the unit are substantially aligned in the vertical direction thereby forming a set of pairs of tray holders. Each pair of tray holders is configured to support the placement of trays. When the racks are not in use, the trays are removed allowing the racks to nest together along their Z-shaped bracket.

Any reference to direction herein such as top, bottom, above, below, horizontal or vertical, etc. is in relation to a typical use configuration.

Dimensions and scales shown in the FIGS. are for illustrative purpose only. Other dimensions and scales may be contemplated. Applicant reserves a right to claim any dimension and scale of a rack and tray shown herein that may be contemplated.

DESCRIPTION

Figure 1:
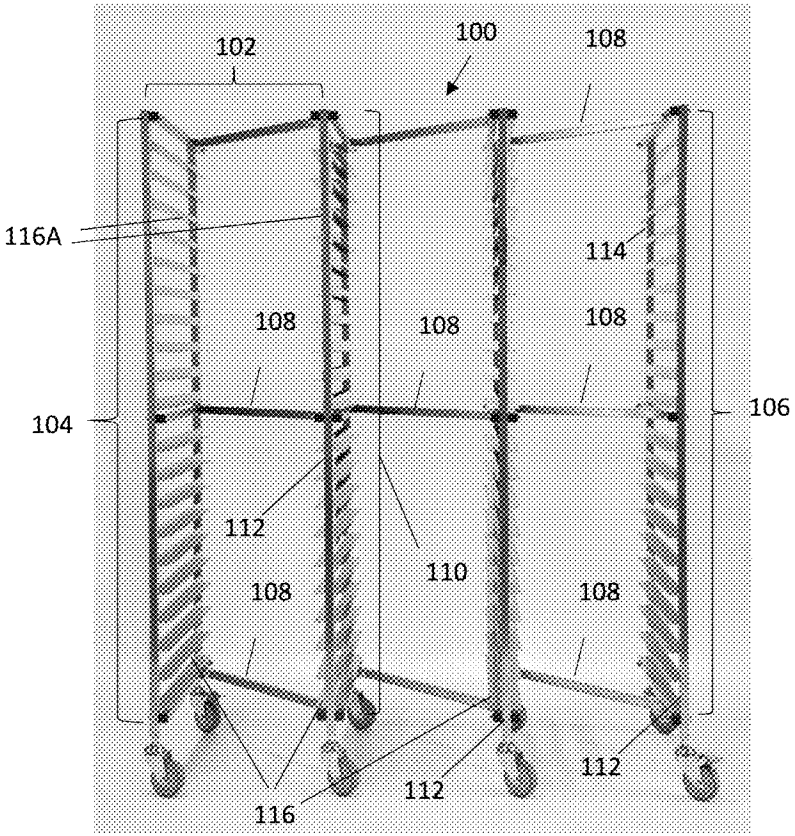
FIG. 1 shows a front perspective view of a rack comprising of three units according to an example.

FIG. 1 shows a front perspective view of a rack 100 comprising of three units (e.g. unit 102) according to an example.

Rack 100 has a frame in which two exterior frame elements (104, 106) are spanned via one or more Z-shaped brackets (e.g. 108). The rack 100 may have one or more interior frame elements (e.g. 110) disposed between the exterior frame elements 104, 106.

Figure 2:
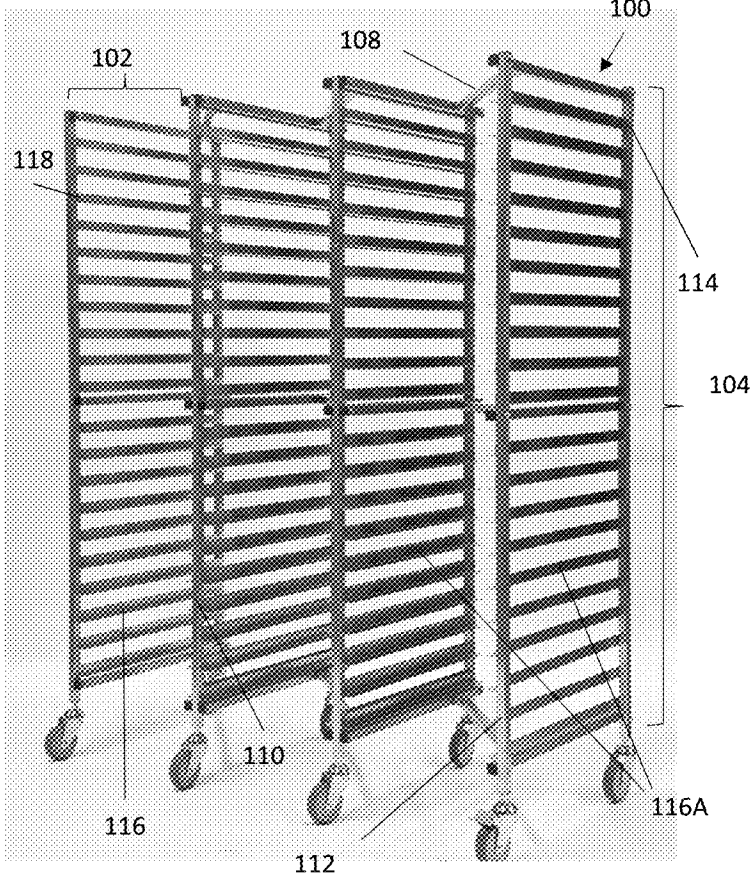
FIG. 2 shows a front right perspective view of a rack comprising of three units according to an example.
Figure 4:
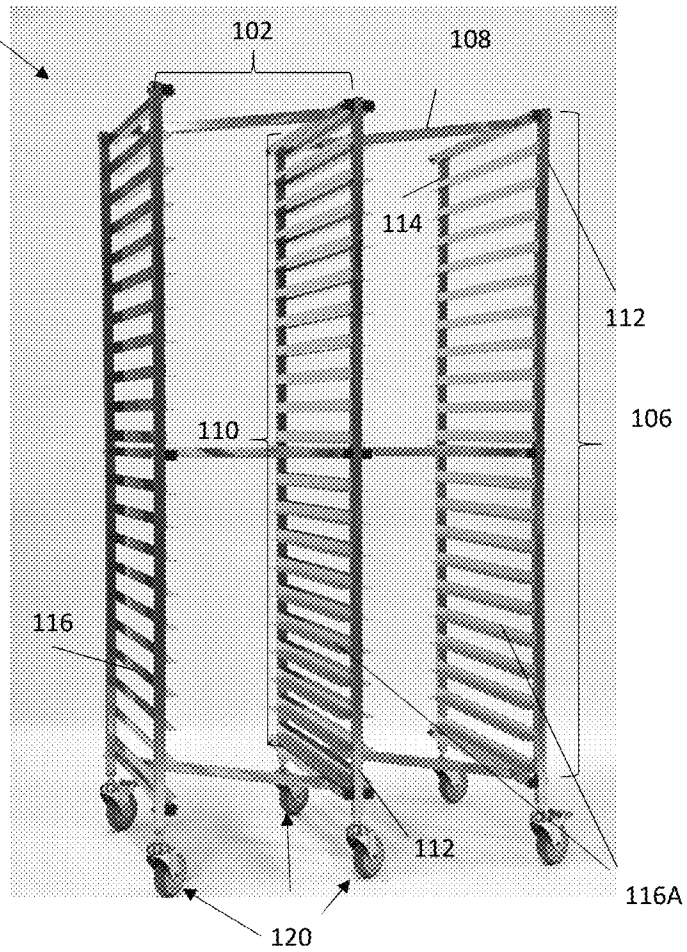
FIG. 4 shows a front left perspective view of a rack comprising of two units according to an example.
Figure 3:
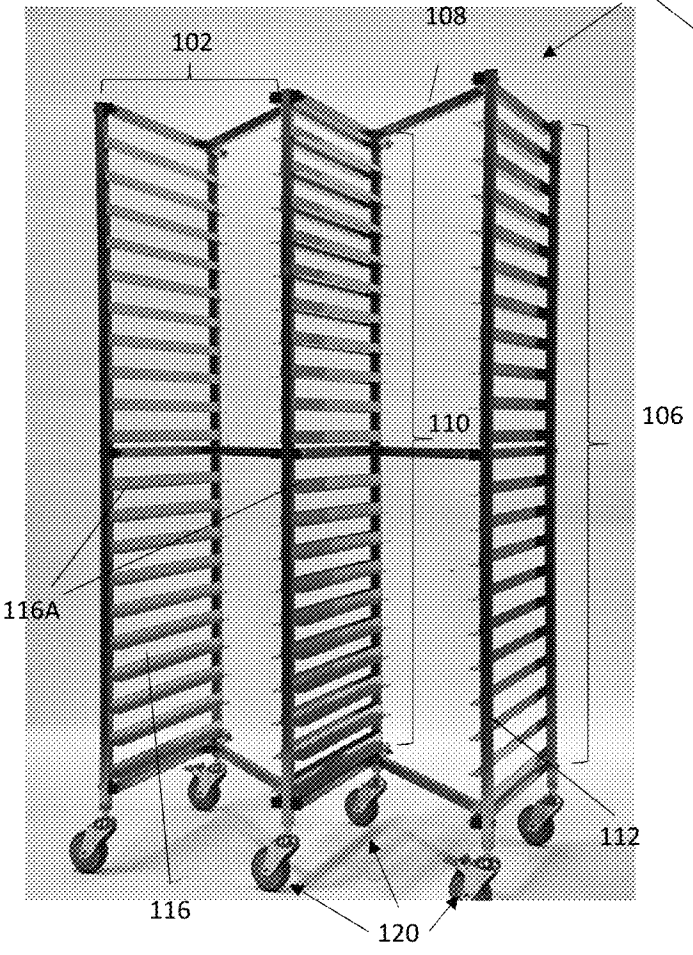
FIG. 3 shows a front right perspective view of a rack comprising of two units according to an example.

In an embodiment, a rack comprises at least one unit 102, wherein each unit 102 is defined by two frame elements (e.g. 104 and 106 or 104, 106 and one or more elements 110) linked together by at least one Z-shaped bracket 108. Two exterior frame elements (e.g. 104 and 106) may link together by at least one Z-shaped bracket 108 to form a rack comprising of one unit 102. Two exterior frame elements (e.g. 104 and 106) may each link to a single interior frame element 110 on either side each by at least one Z-shaped bracket 108 to form a rack comprising of two units (individually unit 102). For each additional unit 102 added to the rack thereafter, a single interior frame element 110 is disposed between the exterior frame elements 104 and 106 and linked to another frame element (e.g. 110) by at least one Z-shaped bracket 108 on either side. Any number of units 102 may be contemplated for a rack described herein. Irrespective of the number of units 102, each unit 102 is comprised of two frame elements linked together by at least one Z-shaped bracket and wherein any single frame element may be shared between two adjacent units. An embodiment of the rack 100 comprising three adjacent units 102 is shown in FIGS. 1 and 2. An embodiment of a rack 100A comprising two adjacent units 102 is shown in FIGS. 3 and 4.

Each frame element (104, 106 and 110) is defined by two vertical support members (e.g. 112, 114) and a plurality of spaced of tray holders (e.g. individually 116, a pair of opposing tray holders on adjacent frame elements 116A). The tray holders are spaced along the vertical support members and extend therebetween. While the tray holders as shown are evenly spaced one to the other on a frame element, and spaced the same on each frame element, they need not be. In an embodiment, the tray holders are parallel and horizontal on a single frame element and equally positioned to another frame element adjacent thereto such that a tray will sit horizontally on a pair of tray holders 116A (e.g. front to back (e.g. between a pair of vertical support members 112 and 114 of a same frame element) and side to side (e.g. between adjacent frame elements)). As such, the tray holders 116 attach to the vertical support members 112 and 114 in a substantially horizontal orientation at spaced apart distances and link the vertical support members together. In one embodiment, the tray holders are "L" shaped with the vertical side 118 being secured to the vertical support members and the horizontal side extending inwards towards the median of the unit to provide support for the placement of trays. Each of the two or more frame elements are configured to cooperatively support a plurality of removable trays, one tray on top of, and spaced from, another tray.

For any given unit of a rack, the tray holders on either side of the unit are substantially aligned in the vertical direction to form a set of pairs of tray holders, each pair (e.g. 116A) configured to support a tray. Each pair of tray holders is configured to receive a respective tray in a substantially horizontal orientation. For embodiments comprising of two or more units, the interior frame element may be shared by adjacent units provided that tray holders are installed on both interior sides of the vertical support members 112 and 114. For the exterior frame elements, tray holders may be installed only on the interior side of the exterior frame elements and not necessarily the exterior side as well.

Figure 6:
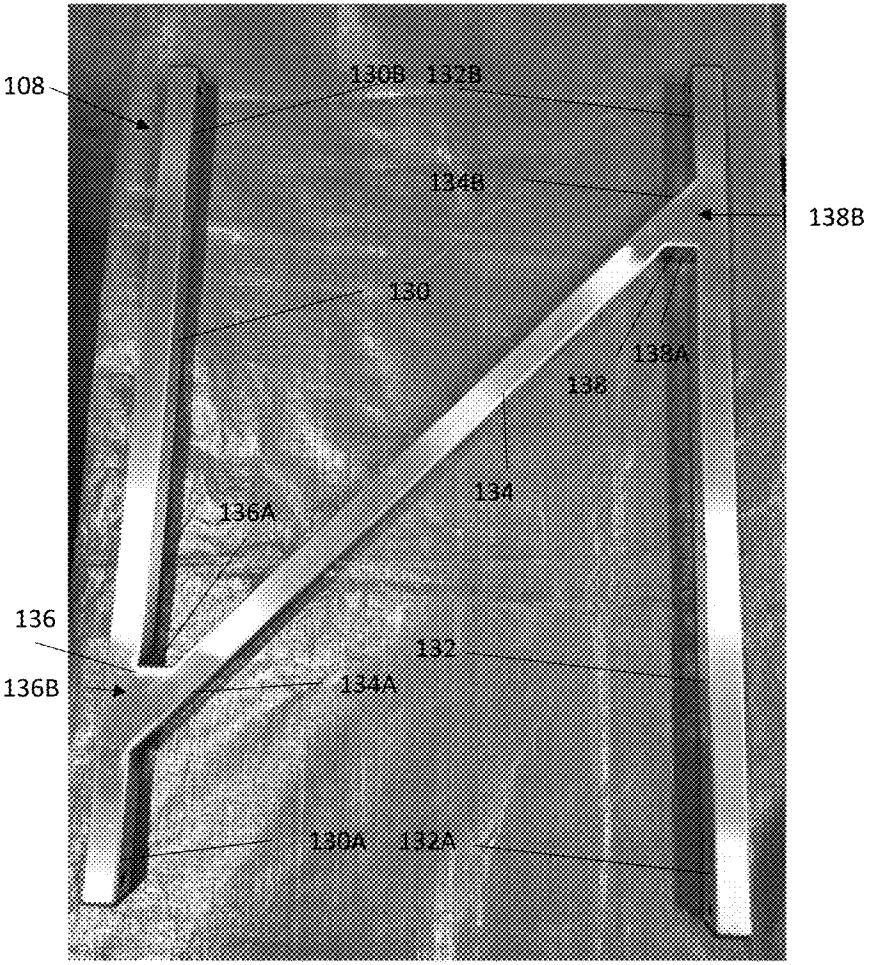
FIG. 6 shows a top perspective view of a Z-shaped bracket.
Figure 5:
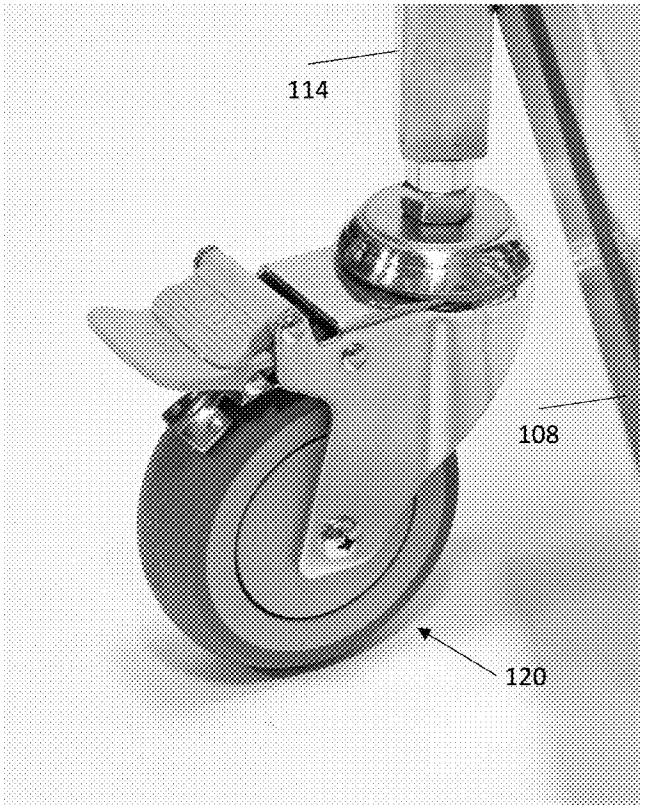
FIG. 5 shows a top perspective view of a wheel attached to the bottom of a frame element according to an example.
Figure 7:
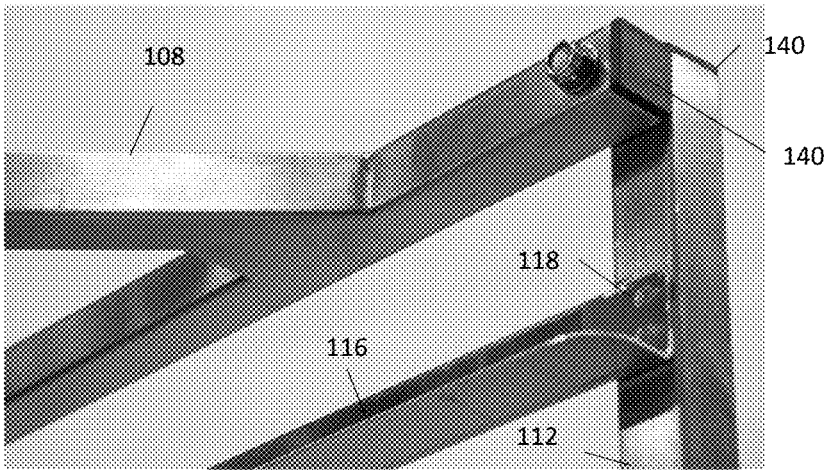
FIG. 7 shows a bottom perspective view a Z-shaped bracket mounted to a frame element according to an example.
Figure 8:
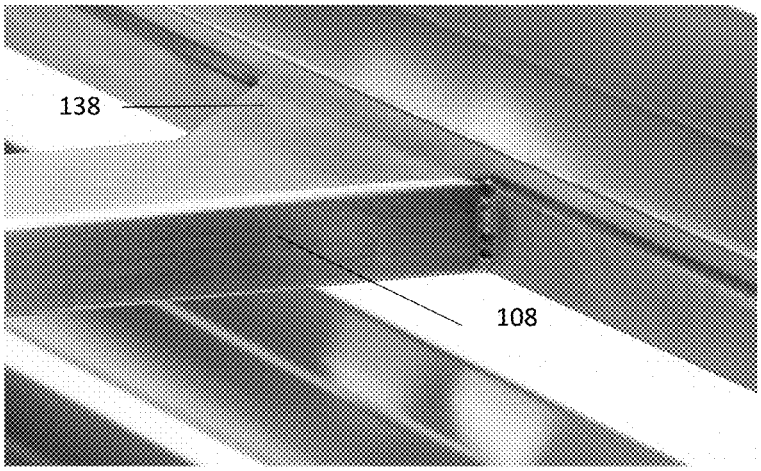
FIG. 8 shows a top perspective view of a Z-shaped bracket mounted to a frame element according to an example.

FIG. 5 shows a top perspective view of a wheel 120 attached to the bottom of a frame element according to an example. FIG. 6 shows a top perspective view of a Z-shaped bracket 108. FIG. 7 shows a bottom perspective view a Z-shaped bracket 108 mounted to a frame element according to an example. FIG. 8 shows a top perspective view of a Z-shaped bracket 108 mounted to a frame element according to an example.

Each frame element is composed of a rigid material such as metal and may at least in part be constructed of extruded components. The bottom of each vertical support member may also include a wheel, caster or other apparatus to help easily move the rack from one place to another (see FIG. 5 for an example of a wheel).

A single unit of a rack is formed by linking two frame elements with a Z-shaped bracket. With reference to FIG. 6, the Z-shaped bracket 108 is formed by linking two parallel (elongated) members 130, 132 with a third diagonal (elongated) member 134. The parallel members have respective ends 130A/13B and 132A/132B. One end of the diagonal member 134A is attached in proximity to one end 130A of the first parallel member 130 while the other end 134B of the diagonal member is attached in proximity to the opposite end 132B of the second parallel member 132. The preferred angle between the diagonal member and the parallel members ranges from 30 to 60 degrees, but other angles may be contemplated. In one embodiment, the length of the parallel members is similar to the length of the tray holders. The Z-shaped bracket 108 is similarly composed of a rigid material such as metal and may be extruded.

With reference to FIGS. 7 and 8, a single unit of a rack is constructed by attaching a frame element on the exterior side of each of the parallel members that make up the Z-shaped brackets. The Z-shaped bracket may link the two frame elements at the top, the bottom, or anywhere in between. To provide more rigid support of the unit, multiple Z-shaped brackets may be used to link the two frame elements. For embodiments comprising of two or more units, each additional unit utilizes one or more additional Z-shaped brackets linking the previous unit on one side and an additional frame element on the other side.

The Z-shaped bracket may optionally include a joint element (e.g. 136 and 138) positioned at the joints formed by the cross member (diagonal member 134) and each of the two parallel members (130, 132). The joint element may be triangle shaped with one side secured to the cross member and another side secured to the parallel member. Each joint element 136, 138 helps cover the crevice formed between the diagonal member and each of the two parallel members and replaces it with a flat surface 136A and 138A (e.g. a planar crevice sealing surface). In an embodiment and as shown the (upper) surface of the joint element and the respective upper surfaces of the diagonal member and a parallel member are co-planer, providing a further flat surface 136A and 138A. Though not shown, the opposite side of Z-shaped bracket 108 also has a flat surface at a joint element 136, 138. A joint element 136, 138 allows the Z-shaped bracket to be reinforced at the joints while also minimizing the trapping of debris and contaminants in what may otherwise be a sharp (tight) crevice. In another embodiment, the cross member and the joint elements are one piece wherein the ends of the diagonal member project outwards to each form a joint element.

In an embodiment, then, each Z-shaped bracket comprises a pair of parallel members and a diagonal member joined therebetween and a respective joint member at each joint between the diagonal member and a respective one of the pair of parallel members. Each joint member provides a planar crevice sealing surface. At each joint: respective first surfaces of the diagonal member, the respective one of the pair of parallel members and the respective joint member define an upper smooth co-planer surface; and respective opposite surfaces of the diagonal member, the respective one of the pair of parallel members and the respective joint member define a lower smooth co-planer surface.

In an example, a rack system is used to dry a plant material in batches. A portion of plant material from a first batch that is trapped is a contaminant relative to plant material of a second batch. Minimizing trapping assists with a cleaning and/or preparation time for a rack such as between uses.

The individual components that make up the frame element, the Z-shaped bracket, and the individual units of the rack may be assembled together by welding or screwing/bolting the components together depending on the materials used to construct the components. Other methods of piecing the components together may include using adhesives such as tape and glue.

In one embodiment, the frame of the rack is constructed out of hollow components (i.e. vertical support members, and the two parallel members and cross member of the Z-shaped bracket). This embodiment of the rack may include water tight features such as end caps, seals, glue, and fittings used in a way to keep water out of any hollow components. For example, the top of each of the vertical support members of each frame element and ends of Z-shaped brackets are sealed with a respective water proof cap (individually 140).

Figure 10:
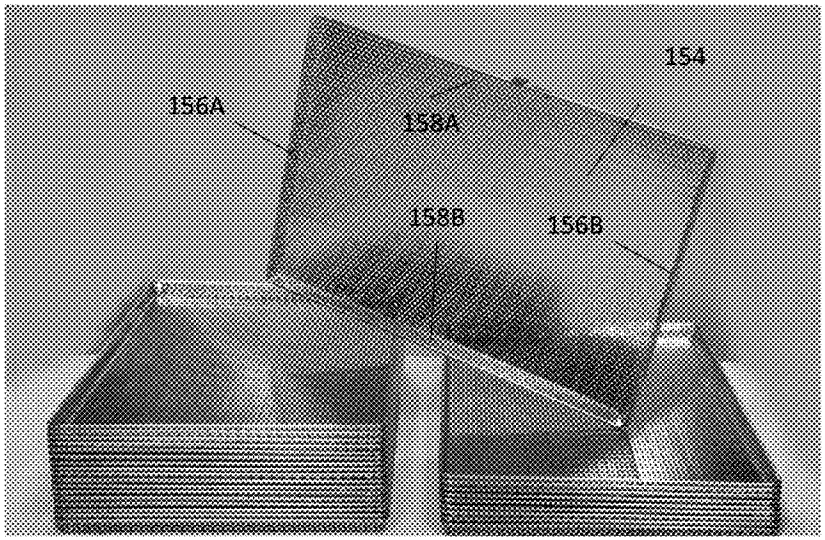
FIG. 10 shows a top perspective view of two stacks of trays and the top side of tray according to an example.
Figure 9:
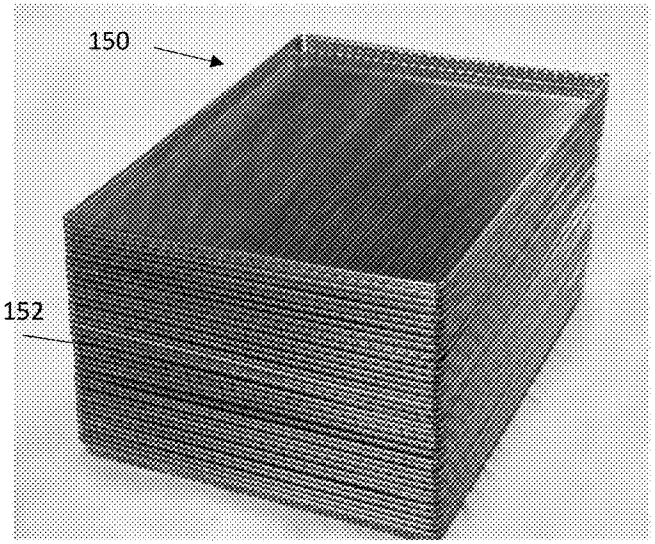
FIG. 9 shows showing a top perspective view of a stack of trays according to an example.

With reference to FIGS. 9 and 10, there is provided a plurality of trays 150 (individually 152) to be used with the rack (e.g. 100/100A). A tray 152 is rectangular and comprises a base portion 154 and respective up-standing opposite side edges (e.g. 156A/156B and 158A/158B). When in use with a rack, a tray is inserted into and removed from the rack 100 along a pair of tray holders 116A on either side of a unit 102. The tray holders help support the weight of the tray. The width of each tray spans the width of a single unit of a rack such that it can be supported by a pair of tray holders. In one embodiment, the length of each tray spans the entire depth of a rack, and in other embodiments, the length of each tray is less than the entire depth of a rack such that a pair of tray holders can accommodate the placement of more than one tray. As illustrated, the depth of a tray is no more than the distance between the tray holders used to support the tray and the tray holders immediately above or below said tray holders.

Figure 13:
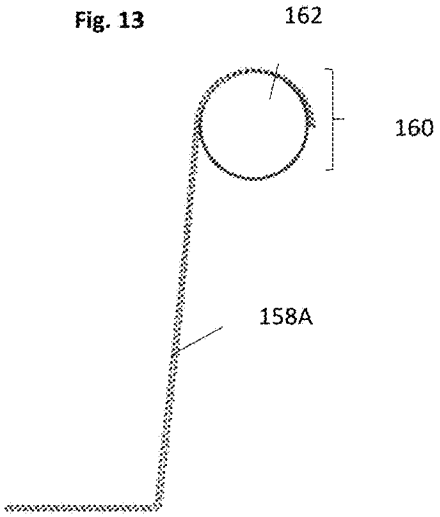
FIG. 13 is a drawing showing a cross section of a tray with a side edge wrapped around a wire element according to an example.

Opposite sides 156A/156B 158A/158B of a tray may each comprise an outwardly projecting flange (e.g. 160) about a top opening of the tray. In one embodiment, the opposite projecting flanges may be received by a pair of the tray holders 116A. In another embodiment, a tray is received by a pair of tray holders 116A at the base portion 154 of the tray. The flanges (e.g. 160) may comprise a wire element 162 (e.g. a single wire element) extending around the tray opening. The wire element 162 may be welded to the edges 156A/156B 158A/158B of the tray body to minimize the exposure of sharp edges on the tray body while helping to reduce crevices where debris and contaminants (e.g. plant material as described in an embodiment) may otherwise be trapped. Such a feature may assist with cleaning of the trays. In an embodiment (e.g. FIG. 13), the tray body (a distal edge portion of a side) wraps around the wire element.

Figure 12:
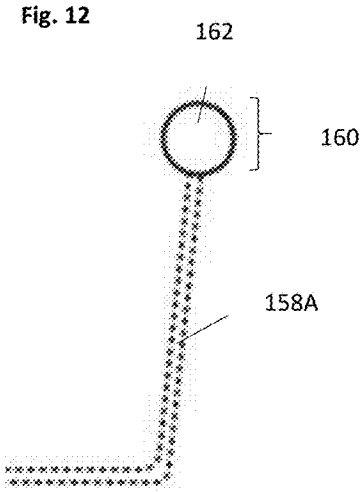
FIG. 12 is a drawing showing a cross section of a tray with a side edge welded to a wire element according to an example.
Figure 11:
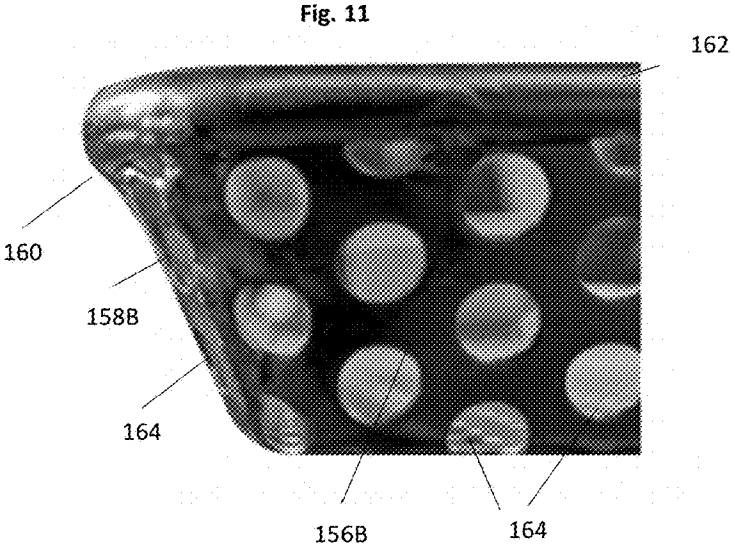
FIG. 11 shows a front perspective view of a corner of a tray according to an example.

The tray body may comprise a flat base portion 154 with upstanding side edges (e.g. 156A/156B 158A/158B) forming the opening. The base portion 154 and optionally the upstanding side edges (e.g. 156A/156B 158A/158B) may be perforated (e.g. with individual perforations 164) thereby helping to accelerate the cooling, drying or aerating process by at least in part also exposing the goods placed on the tray to the environmental condition from the bottom and sides. The perforations may be of any shapes or sizes. The upstanding side edges 156A/156B 158A/158B may be angled inwards, outwards, or substantially vertical. The upstanding side edges 156A/156B 158A/158B may also be welded to the wire element to minimize the exposure of sharp edges on the upstanding side edges while helping to reduce crevices where debris and contaminants may otherwise be trapped. Such a design feature may assist with cleaning of the trays (see FIGS. 11 and 12). In another embodiment, the upstanding side edges wrap around the wire element (see FIG. 13).

The trays 152 may be stackable and constructed from a rigid material such as metal. The size and thickness of the trays may also be customized.

The racks and trays may be made of a food grade material such as stainless steel and suitable plastic materials. The exterior surfaces of racks and trays may also be smooth throughout to minimize crevices where debris and contaminants may otherwise be trapped and for ease of cleaning.

Figure 15:
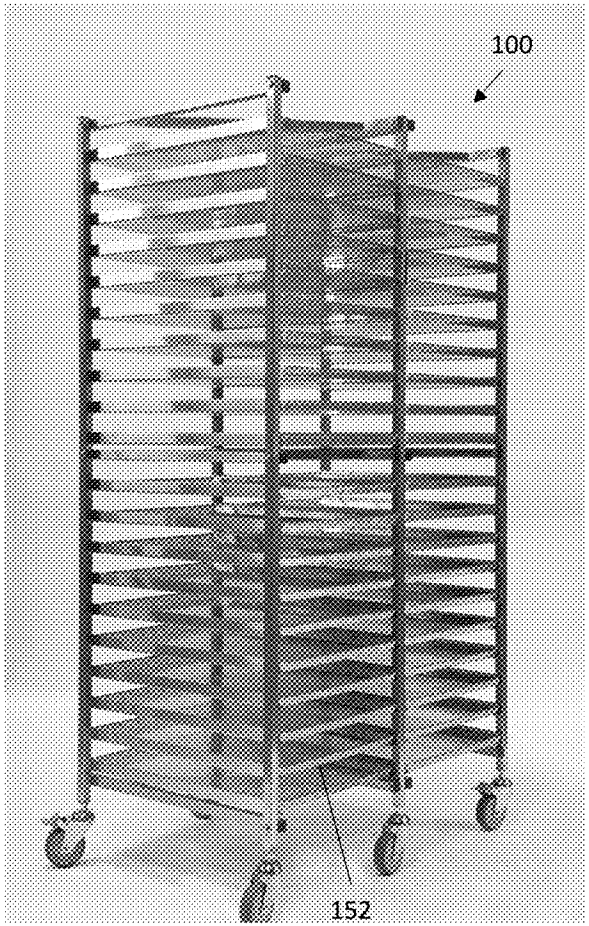
FIG. 15 shows a front left perspective view of a rack comprising of two units with trays inserted into all the tray holders according to an example.
Figure 14:
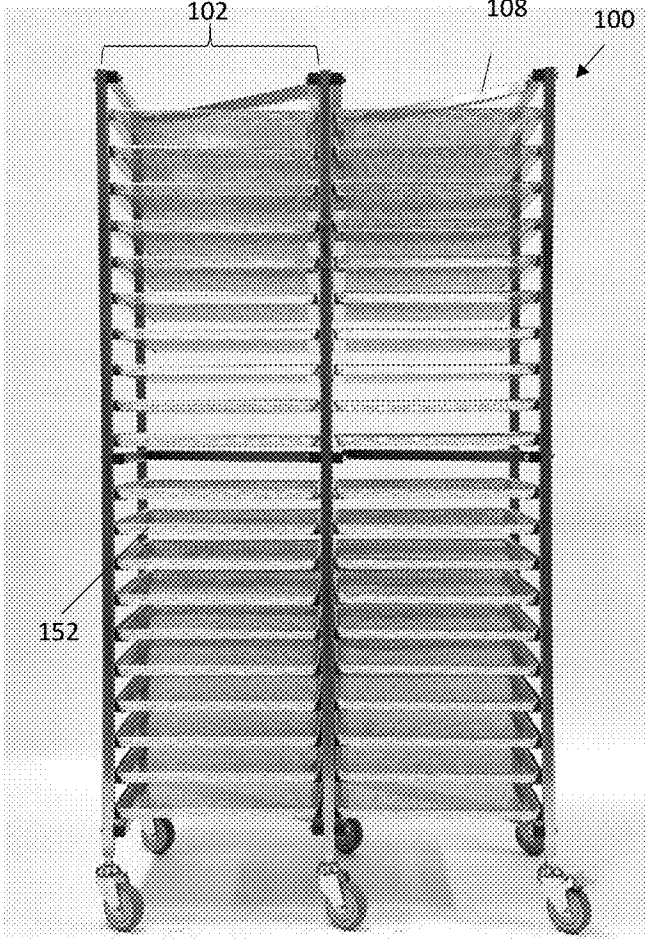
FIG. 14 shows a front perspective view of a rack comprising of two units with trays inserted into all the tray holders according to an example.
Figure 17:
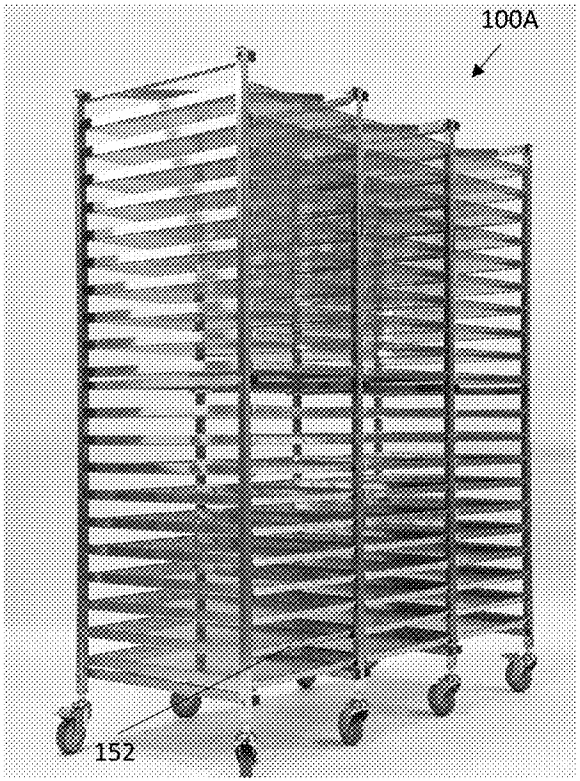
FIG. 17 shows a front left perspective view of a rack comprising of three units with trays inserted into all the tray holders according to an example.
Figure 16:
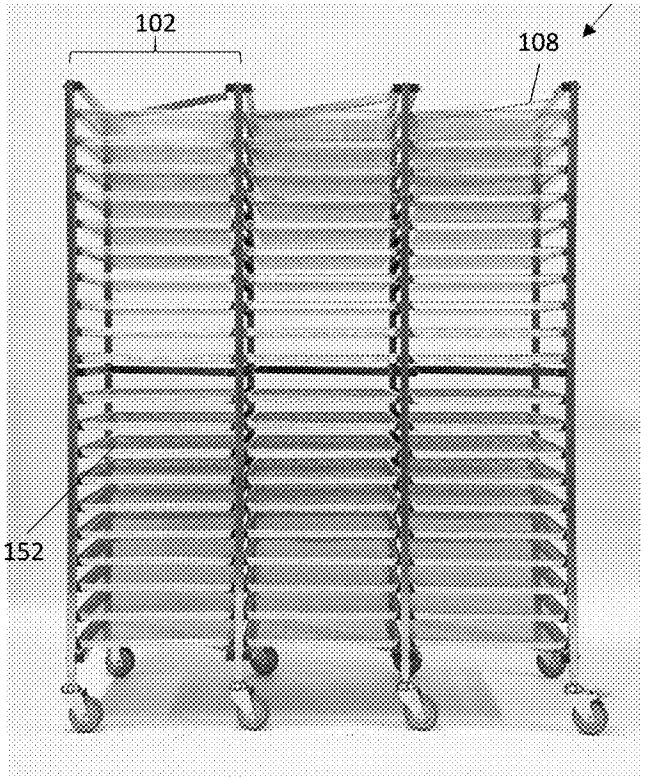
FIG. 16 shows a front perspective view of a rack comprising of three units with trays inserted into all the tray holders according to an example.
Figure 19:
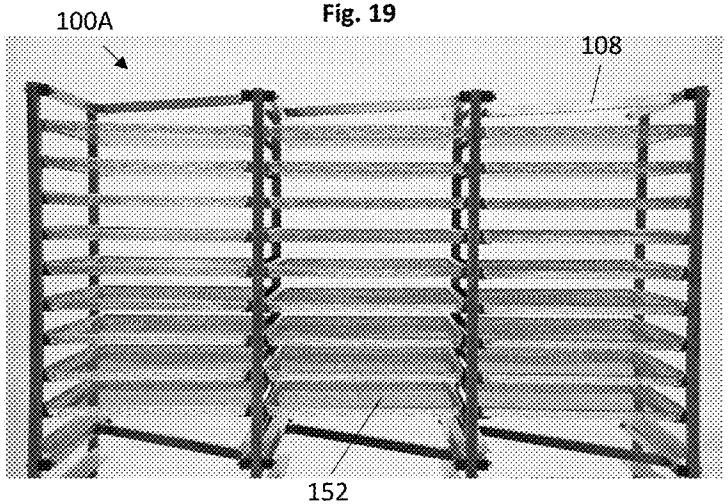
FIG. 19 shows a front perspective view of the top portion of a rack comprising of three units with trays inserted into the tray holders of only the top portion of the three units according to an example.
Figure 18:
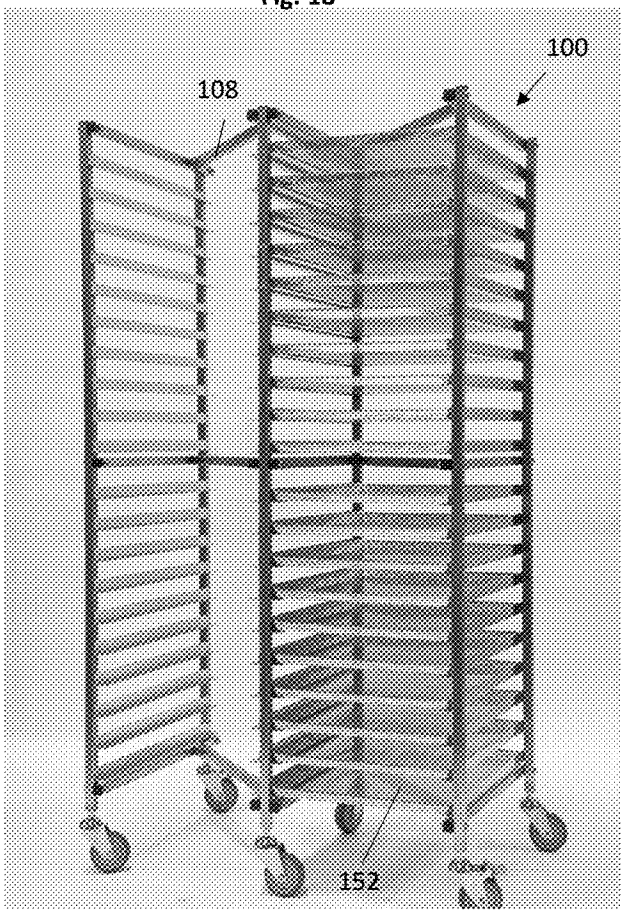
FIG. 18 shows a front right perspective view of a rack comprising of two units with trays inserted into the tray holders of only one of the two units according to an example.

A rack comprising of two units with trays placed on every available pair of tray holder is shown in FIGS. 14 and 15 and the same is shown for a rack comprising of three units in FIGS. 16 and 17. It is not necessary to completely fill the rack with trays at every available pair of tray holder. For example, FIG. 18 shows a rack comprising of two units where only one of the two units are filled with trays, and FIG. 19 shows a rack comprising of three units where only the top portion of each of the three units are filled with trays.

The rack according to the present invention may function as a cooling rack, a drying rack, an aerating rack, and/or a storage rack. For example, the rack may be used to cool freshly baked goods, dry organic matter (e.g. a plant material), aerate odorous fabrics, and store overstock items. The present invention is in no way limited to these listed functions and other functions of the rack may be contemplated. By way of example, one may contemplate using the rack according to the present invention for the heating of goods by placing the entire rack in a heat-controlled environment.

Figure 21:
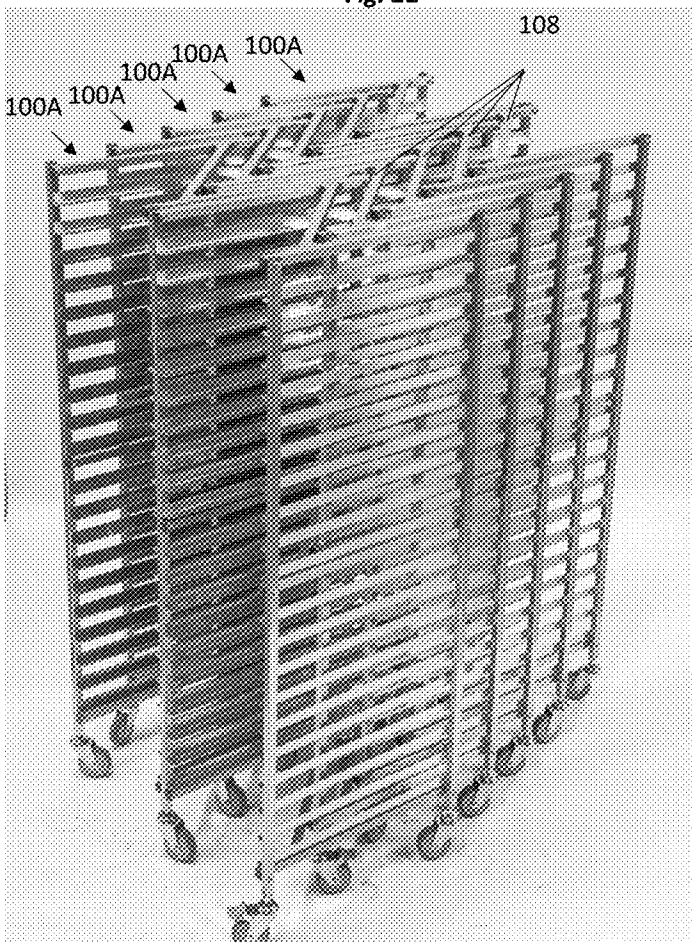
FIG. 21 shows a top left perspective view of a plurality of racks comprising of two units which have been nested together according to an example.
Figure 20:
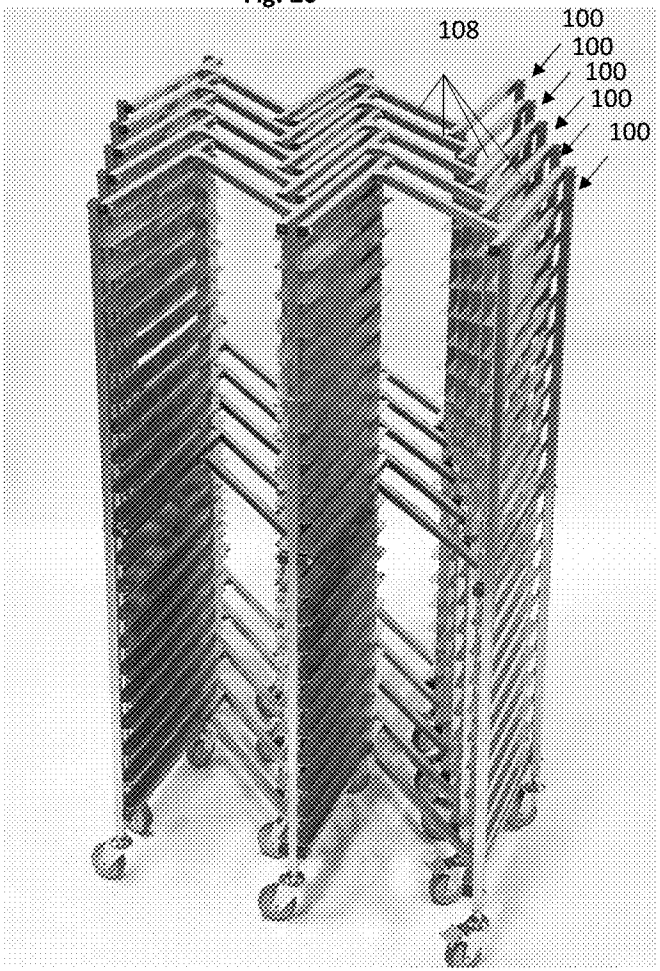
FIG. 20 shows a top perspective view of a plurality of racks comprising of two units which have been nested together according to an example.

When the racks are not in use and the trays have been removed from the tray holders, the racks may be nested together to minimize the space required for their collective storage. Accordingly, there is provided a system of racks for space saving storage using the rack described herein. With reference to FIGS. 20 and 21, the racks 100 and 100A are aligned along the Z-shaped brackets 108. In particular, the joints between the diagonal member and each of the parallel members of the Z-shaped bracket of one rack are nested with the corresponding joints of the Z-shaped bracket of a second rack. A plurality of racks may be nested together into one nest to form a system of racks.

What is claimed is:

1. A system of racks for cooling, heating, drying or aerating goods or materials, the system comprising:

two or more racks, each rack comprising:

a frame having:

a first exterior frame element;

a second exterior frame element; and at least one Z-shaped bracket linking the first exterior frame element and the second exterior frame element;

wherein each Z-shaped bracket comprises a pair of parallel members and a diagonal member joined therebetween and a respective joint member at each joint between the diagonal member and a respective one of the pair of parallel members, each joint member providing a planar crevice sealing surface; and wherein, at each joint:

respective first surfaces of the diagonal member, the respective one of the pair of parallel members and the respective joint member define a first smooth co-planar surface; and respective opposite surfaces of the diagonal member, the respective one of the pair of parallel members and the respective joint member define an opposite smooth co-planar surface; and a plurality of trays for receiving the goods or materials, each tray comprising:

at least four side edges forming an opening; and a substantially planar base wherein a periphery of the base portion connects to a base of each of the at least four side edges; and wherein the at least four side edges comprise a pair of substantially parallel opposing edges defining outwardly projecting flanges relative to the opening, the substantially planar base defining a plurality of spaced perforations configured to allow airflow to the goods or materials.

2. The system of racks according to claim 1 wherein, in each rack, one of the Z-shaped brackets links a top of the first exterior frame element and a top of the second exterior frame element and one of the Z-shaped brackets links a bottom of first exterior frame element and a bottom of the second exterior frame element.

3. The system of racks according to claim 1 wherein, in each rack, the first exterior frame element and the second exterior frame elements each comprise two vertical support members where the two vertical support members of the first exterior frame element support and are linked by a first plurality of tray holders and where the two vertical support members of the second exterior frame element support and are linked by a second plurality of tray holders.

4. The system of racks according to claim 3 wherein, in each rack, the respective plurality of tray holders are secured to the respective two vertical support members such that when the rack is assembled the respective plurality of tray holders face an interior of the rack and each other.

5. The system of racks according to claim 3 wherein, in each rack, the respective plurality of tray holders are secured in a spaced relationship along the respective two vertical support members.

6. The system of racks according claim 3, wherein the first plurality of tray holders are substantially aligned in the vertical direction with the second plurality of tray holders forming a set of pairs of tray holders.

7. The system of racks according to claim 6 wherein, in each rack, each of the pairs of tray holders is configured to receive and support one of the trays.

8. The system of racks according to claim 7 wherein, in each rack, each of the pairs of tray holders is configured to receive and support the tray by projecting flanges of the tray.

9. The system of racks according to claim 7 wherein, in each rack, each of the pairs of tray holders is configured to receive and support the tray by the base of the tray.

10. The system of racks according to claim 1 wherein the racks and the trays are made of a rigid material.

11. The system of racks according to claim 1 wherein the racks and the trays are made of a food grade material.

12. The system of racks according to claim 3 wherein, in each rack, the vertical support members or the at least one Z-shaped bracket are hollow.

13. The system of racks according to claim 12 wherein each rack further comprises a water tight fitting on an end of any one of the vertical support members or the at least one Z-shaped bracket.

14. The system of racks according to claim 1 wherein each rack comprises wheels, casters or other rolling apparatus to facilitate movement of the racks.

15. The system of racks according to claim 4 wherein each rack comprises at least one interior frame element between the first exterior frame element and the second exterior frame element;

at least a first Z-shaped bracket linking the first exterior frame element and the at least one interior frame element; and at least a second Z-shaped bracket linking the second exterior frame element and the at least one interior frame element.

16. The system of racks according to claim 15 wherein, in each rack, the plurality of tray holders are secured to the interior side, relative to the rack as assembled, of the two vertical support members of each of the exterior frame elements.

17. The system of racks according to claim 16 wherein, in each rack, the plurality of tray holders are secured to both interior sides of the two vertical support members of the at least one interior frame element.

18. The system of racks according to claim 1 wherein the two or more racks are configured to nest together along their at least one Z-shaped brackets.

19. The system of racks of claim 18 wherein, in each tray, the outwardly projecting flanges comprise a wire element.

20. The system of racks of claim 18 wherein the wire element extends around each of the side edges and is welded thereto, and each of the side edges is rolled over the wire element.

21. The system of racks of claim 1, wherein the side edges of the trays also define spaced perforations.

22. The system of racks of claim 1, wherein the spaced perforations are circular.

23. The system of racks of claim 1, wherein the goods or materials include plant matter to be dried.

* * * * *